US007785764B2

(12) United States Patent
Williams

(10) Patent No.: US 7,785,764 B2
(45) Date of Patent: Aug. 31, 2010

(54) IMAGE TRANSFER MATERIAL AND HEAT TRANSFER PROCESS USING THE SAME

(76) Inventor: Scott A. Williams, 105 Kensington Ct., Livonia, NY (US) 14487

( * ) Notice: Subject to any disclaimer, the term of this patent is extended or adjusted under 35 U.S.C. 154(b) by 479 days.

(21) Appl. No.: 10/589,023

(22) PCT Filed: Feb. 9, 2005

(86) PCT No.: PCT/US2005/003868

§ 371 (c)(1),
(2), (4) Date: Mar. 8, 2007

(87) PCT Pub. No.: WO2005/077664

PCT Pub. Date: Aug. 25, 2005

(65) Prior Publication Data

US 2007/0172610 A1 Jul. 26, 2007

Related U.S. Application Data

(60) Provisional application No. 60/542,885, filed on Feb. 10, 2004.

(51) Int. Cl.
*G03C 8/00* (2006.01)
*B41M 5/00* (2006.01)

(52) U.S. Cl. ..... 430/200; 428/32.51; 428/32.72; 428/32.73; 428/32.79; 428/32.87; 428/36.1; 428/347; 428/355 R

(58) Field of Classification Search ..... 430/200; 428/32.51, 32.72, 32.73, 32.79, 32.87, 36.1, 428/347, 355 R
See application file for complete search history.

(56) References Cited

U.S. PATENT DOCUMENTS

| | | | |
|---|---|---|---|
| 3,222,419 | A | 12/1965 | Jubilee et al. |
| 3,257,478 | A | 6/1966 | Jubilee et al. |
| 3,658,570 | A | 4/1972 | Crooks et al. |
| 3,936,542 | A | 2/1976 | Cox |

(Continued)

FOREIGN PATENT DOCUMENTS

| | | |
|---|---|---|
| CH | 82483/59 | 7/1964 |

(Continued)

OTHER PUBLICATIONS

English Abstract of JP 2147291 (Jun. 6, 1990).

(Continued)

*Primary Examiner*—Thorl Chea

(57) ABSTRACT

Provided is an image transfer material, comprising an optional support material, and a non-woven or woven fiber web layer, wherein the fiber web is impregnated or coated with a image receiving formulation. The fiber web layer is optionally attached to the support with an adhesion layer. Also provided is a heat transfer process wherein after imaging, the fiber web and adhesion layer are peeled from the optional support material and placed, preferably image side up (when imaged), on top of a receptor element. Alternatively, the fiber web and adhesion layer are peeled and then optionally imaged prior to being placed on the receptor element. Then, an optional non-stick sheet is placed over the imaged fiber web (if placed imaged side up) and heat is applied to the fiber web or the non-stick sheet, if present. The adhesion layer then melts and adheres the imaged web layer to the receptor element.

62 Claims, 2 Drawing Sheets

U.S. PATENT DOCUMENTS

| | | | |
|---|---|---|---|
| 4,021,591 | A | 5/1977 | DeVries et al. |
| 4,189,395 | A | 2/1980 | Bland |
| 4,235,657 | A | 11/1980 | Greenman et al. |
| 4,284,456 | A | 8/1981 | Hare |
| 4,322,467 | A | 3/1982 | Heimbach et al. |
| 4,337,289 | A | 6/1982 | Reed et al. |
| 4,351,871 | A | 9/1982 | Lewis et al. |
| 4,477,622 | A | 10/1984 | Sanderson et al. |
| 4,555,436 | A | 11/1985 | Geurtsen et al. |
| 4,726,979 | A | 2/1988 | Chapman |
| 4,773,953 | A | 9/1988 | Hare |
| 4,863,781 | A | 9/1989 | Kronzer |
| 4,869,957 | A | 9/1989 | Vankerckhoven et al. |
| 4,966,815 | A | 10/1990 | Hare |
| 4,980,224 | A | 12/1990 | Hare |
| 5,019,475 | A | 5/1991 | Higashiyama et al. |
| 5,104,719 | A | 4/1992 | Kamen et al. |
| 5,139,917 | A | 8/1992 | Hare |
| 5,163,247 | A | 11/1992 | Weber et al. |
| 5,236,801 | A | 8/1993 | Hare |
| 5,242,739 | A | 9/1993 | Kronzer et al. |
| 5,242,781 | A | 9/1993 | Ohbayashi et al. |
| 5,271,990 | A | 12/1993 | Kronzer et al. |
| 5,366,837 | A | 11/1994 | Sakai |
| 5,370,132 | A | 12/1994 | Weber et al. |
| 5,441,056 | A | 8/1995 | Weber et al. |
| 5,501,902 | A | 3/1996 | Kronzer |
| 5,603,996 | A | 2/1997 | Overcash et al. |
| 5,612,168 | A | 3/1997 | Ishikawa |
| 5,620,548 | A | 4/1997 | Hare |
| 5,665,479 | A | 9/1997 | Vandamme et al. |
| 5,678,247 | A | 10/1997 | Vickers |
| 5,741,387 | A | 4/1998 | Coleman |
| 5,759,738 | A | 6/1998 | Tsuno et al. |
| 5,798,179 | A | 8/1998 | Kronzer |
| 5,882,388 | A | 3/1999 | Adair et al. |
| 5,925,712 | A | 7/1999 | Kronzer |
| 5,948,586 | A | 9/1999 | Hare |
| 6,033,824 | A | 3/2000 | Hare et al. |
| 6,228,543 | B1 | 5/2001 | Mizuno et al. |
| 6,531,216 | B1 * | 3/2003 | Williams et al. ..... 428/347 |

FOREIGN PATENT DOCUMENTS

| | | | |
|---|---|---|---|
| DE | 44 32 383 | C1 | 11/1995 |
| EP | 0 728 801 | A2 | 8/1996 |
| EP | 0 820 874 | A1 | 1/1998 |
| EP | 0 842 787 | A1 | 5/1998 |
| FR | 2 442 721 | | 6/1980 |
| FR | 2 690 873 | | 11/1993 |
| GB | 2 202 641 | A | 9/1988 |
| WO | WO-93/21561 | A1 | 10/1993 |
| WO | WO-97/18090 | A1 | 5/1997 |
| WO | WO-98/20393 | A1 | 5/1998 |
| WO | WO-98/21398 | A1 | 5/1998 |

OTHER PUBLICATIONS

Patent Abstracts of Japan: vol. 005, No. 005 (P-044), Jan. 14, 1981 & JP 55135853 A (Fuji Xerox Co. Ltd), Oct. 23, 1980 abstract.

Patent Abstracts of Japan: vol. 009, No. 078 (C-274), Apr. 6, 1985 & JP 59210978 A (Dainippon Ink Kagaku Kogyo KK), Nov. 29, 1984 abstract.

Patents Abstracts of Japan: vol. 199, No. 01, Jan. 30, 1998 & JP 09248974 A (OJI Paper Co Ltd), 22 Sep. 11, 1997 (Sep. 22, 1997) abstract.

English Abstract of JP 8324106 (Dec. 10, 1996).

* cited by examiner

IMAGE TRANSFER MATERIAL AND HEAT TRANSFER PROCESS USING THE SAME

This National Phase PCT application claims priority under 35 U.S.C. 119(e) on U.S. Provisional Application No(s). 60/542,885, filed on February 10, of which is hereby incorporated by reference.

BACKGROUND OF THE INVENTION

1. Field of the Invention

The present invention relates to an image transfer material, comprising a support material, and a non-woven or woven fiber web layer, wherein the fiber web is impregnated or coated with materials that constitute an image receiving formulation. The fiber web layer is attached to the support by an adhesion layer. The top surface of the fiber web is receptive to images, for instance, ink jet images, photocopy images, etc. Optionally, one or more opaque layers may be coated between the adhesion layer and the fiber web. The optional opaque layer(s) adds a rigid or stiff quality to the transfer material for ease of handling, as well as having opacity, especially white, to enhance visibility of the image when placed thereon.

The present invention further relates to a heat transfer process using the same material. For instance, after imaging, the fiber web and adhesion layer are peeled away from the support material and placed, preferably image side up, on top of a receptor element, such as cotton or cotton/polyester blend fabrics or the like. A non-stick sheet is then placed over the imaged fiber web and heat, for instance, from a source such as a hand iron, is applied to the top of the non-stick sheet. If a heat source such as an oven is used, a non-stick sheet is unnecessary. A non-stick sheet is also not necessary if the material does not stick to the heat source, such as a stick-free hand iron or heat press. The adhesion layer then melts and adheres the imaged web layer to the receptor element. After heat application, the non-stick sheet is removed and the imaged fiber web remains attached to the receptor element.

2. Description of the Prior Art

Textiles such as shirts (e.g., tee shirts) having a variety of designs thereon have become very popular in recent years. Many shirts are sold with pre-printed designs to suit the tastes of consumers. In addition, many customized tee shirt stores are now in the business of permitting customers to select designs or decals of their choice. Processes have also been proposed which permit customers to create their own designs on transfer sheets for application to tee shirts by use of a conventional hand iron, such as described in U.S. Pat. No. 4,244,358. Furthermore, U.S. Pat. No. 4,773,953, is directed to a method for utilizing a personal computer, a video camera or the like to create graphics, images, or creative designs on a fabric. These designs may then be transferred to the fabric by way of an ink jet printer, a laser printer, or the like.

Other types of heat transfer sheets are known in the art. For example, U.S. Pat. No. 5,798,179 is directed to a printable heat transfer material using a thermoplastic polymer such as a hard acrylic polymer or poly(vinyl acetate) as a barrier layer, and has a separate film-forming binder layer. U.S. Pat. No. 5,271,990 relates to an image-receptive heat transfer paper which includes an image-receptive melt-transfer film layer comprising a thermoplastic polymer overlaying the top surface of a base sheet. U.S. Pat. No. 5,502,902 relates to a printable material comprising a thermoplastic polymer and a film-forming binder. U.S. Pat. No. 5,614,345 relates to a paper for thermal image transfer to flat porous surfaces, which contains an ethylene copolymer or a ethylene copolymer mixture and a dye-receiving layer.

Other examples of heat transfer materials are disclosed by, for example, U.S. Pat. No. 6,410,200 which relates to a polymeric composition comprising an acrylic dispersion, an elastomeric emulsion, a plasticizer, and a water repellant. U.S. Pat. No. 6,358,660 relates to a barrier layer. The barrier layer of U.S. Pat. No. 6,358,660 provides for "cold peel," "warm peel" and "hot peel" applications and comprises thermosetting and/or ultraviolet (UV) curable polymers. U.S. application Ser. No. 09/980,589, filed Dec. 4, 2001, relates to a transferable material having a transfer blocking overcoat and to a process using said heat transferable material having a transfer blocking overcoat.

Some of the above-mentioned applications contain specific systems for forming clear images which are subsequently transferred onto the receptor element. However, other heat transfer systems exist, for example, those disclosed by U.S. Pat. Nos. 4,021,591, 4,555,436, 4,657,557, 4,914,079, 4,927,709, 4,935,300, 5,322,833, 5,413,841, 5,679,461, 5,741,387, and 6,432,514.

Problems with many known transfer sheets is the expense involved in coating numerous solutions onto a support material and the overall feel of the imaged product. However, the present invention represents a revolution in the image transfer industry. It is very inexpensive, has a very soft feel to the touch, and can be washed in the washing machine with detergent. No special washing or drying procedures are required in order to preserve the transferred image. Additionally, it includes the advantages of a "peel-away" imaging material. With a peel-away material, the image that is placed on the imaging material is transferred directly to the receptor element without need of an inverted or reversed image, such as disclosed in U.S. Pat. No. 6,383,710 B2. Traditional transfer materials required images to be added to the material in an inverted or reversed orientation so that the image, when placed face down on the receptor element, would appear in the correct orientation in the final product.

SUMMARY OF THE INVENTION

In order to attract the interest of consumer groups that are already captivated by the tee shirt rage described above, the present invention provides, in one embodiment, an improved transfer sheet. In another embodiment, the present invention provides for a process of heat transfer of images to receptors.

The present invention relates to a transfer sheet, comprising: a support sheet having a first and a second surface; and a woven or non-woven web layer on the first surface of the support, wherein an adhesion layer is placed between the support sheet and the web layer, and wherein the web layer is impregnated and/or coated with an image receiving formulation.

An alternate embodiment, of the present invention, comprises a woven or non-woven web layer having a first and second surface; wherein an adhesion layer is placed on the second surface of the web layer, and wherein the web layer is impregnated and/or coated with an image receiving formulation.

The present invention further provides for a process for heat transferring an imaged area from a transfer sheet to a receptor element (such as a tee shirt). First, the top surface of the web layer is optionally imaged using any conventional imaging technique. Next, the web layer and adhesion layer are peeled away from the optional support material. Then the imaged web layer is placed, preferably imaged side up (when imaged), on top of a receptor element and optionally imaged.

Alternatively, the web layer and adhesion layer are first peeled away from the optional support, then optionally imaged, and then placed, preferably imaged side up (when imaged) on top of the receptor element and optionally imaged. Next, heat is applied (e.g., by way of a hand iron, a heat press or an oven), to (e.g., the top of) the image. If a hand iron or a heat press are used, a tack-free sheet should be placed between the iron or press and the imaged web, unless the heating device is itself tack-free. Upon heating, the adhesion layer melts and adheres the imaged web layer to the receptor element. The image receiving formulation binder will preferably crosslink and set without melting and flowing, and does not have an adhesive function. The imaged web layer is thus attached to the receptor element.

BRIEF DESCRIPTION OF THE DRAWINGS

The present invention will become more fully understood from the detailed description given hereinbelow, and the accompanying drawings that are given by way of illustration only and thus are not limitive of the present invention, and wherein:

FIG. 2 illustrates the step of ironing the transfer element of the present invention onto a tee shirt or the like.

DETAILED DESCRIPTION OF THE INVENTION

Figure 1:
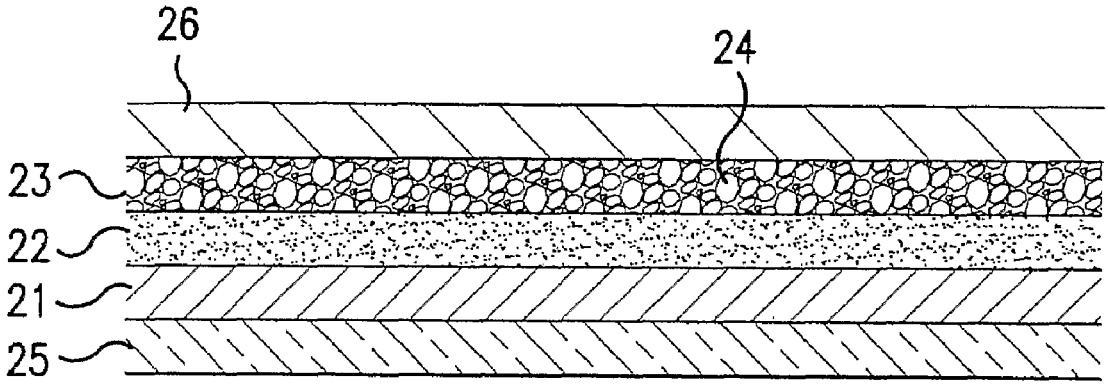
FIG. 1 is a cross-sectional view of one embodiment of the transfer element of the present invention.

The present invention includes a thermal transfer sheet and a transfer method for transferring the image area from said thermal transfer sheet to a receptor element.

The present invention provides for a transfer sheet which comprises: support sheet having a first and a second surface; a woven or non-woven web layer on the first surface of the support, and an adhesion layer between the support sheet and the web layer, wherein the web layer is impregnated and/or coated with an image receiving formulation.

An alternate embodiment of the present invention, comprises a woven or non-woven web layer having a first and second surface; wherein an adhesion layer is placed on the second surface of the web layer, and wherein the web layer is impregnated and/or coated with an image receiving formulation.

The present invention also provides for a kit containing the transfer sheet of the present invention and optionally instructions for transferring an image thereon to a receptor. The kit may also optionally contain a tack-free sheet, markers, paint, crayons, tee-shirts, prep-shirts or other design aids.

The present invention also provides for an alternate kit containing the transfer sheet of the present invention in the shape of a pocket to be adhered to a shirt. In this embodiment, the web layer will constitute the material of the pocket and the adhesion layer is applied only to the periphery of the pocket, leaving an opening at the top of the pocket as in any conventional shirt pocket. An image may be applied to the face of the impregnated web layer and the pocket adhered to a receptor element, for instance a shirt, in the same manner as described below.

The present invention further provides for a method of heat transferring an image from the transfer material to a receptor element. First, the top surface of the web layer is optionally imaged using any conventional imaging technique including but not limited to, ink jet printers, bubblejet printers, thermal inkjet methods, piezo inkjet methods, laser printers, crayons, and the like.

Second, the web layer, adhesion layer and optional image are transferred to the receptor element. To accomplish the transfer, the optionally imaged web layer and adhesion layer are peeled away (e.g., peeled in the absence of water or other chemical aid) from the optional support material. Then the optionally imaged web layer is placed, imaged side up, on top of a receptor element. Next, heat is applied by way of a hand iron, a heat press or an oven, to the top of the image. If a hand iron or a heat press are used, a tack-free sheet should be placed between the iron or press and the imaged web, unless the hand iron or heat press are tack-free. Upon heating, the adhesion layer melts and bonds the web layer to the receptor element. The imaged web layer is thus attached to the receptor element.

A. The Transfer Material

1. Optional Support Layer

The optional support layer is a thin flexible, but non-elastic carrier sheet. The support is not particularly limited and may be any conventional support sheet which is suitably flexible. Typically, the support sheet is a paper web, plastic film, metal foil, wood pulp fiber paper, vegetable parchment paper, lithographic printing paper or similar material.

In one embodiment of the present invention an appropriate support material may include but is not limited to a cellulosic nonwoven web or film, such as a smooth surface, heavyweight (approximately 24 lb.) laser printer or color copier paper stock or laser printer transparency (polyester) film. However, highly porous supports are less preferred because they tend to absorb large amounts of any material coated thereon. The particular support used is not known to be critical, so long as the support has sufficient strength for handling, copying, coating, heat transfer, and other operations associated with the present invention. Accordingly, in accordance with some embodiments of the present invention, the support may be the base material for any printable material, such as described in U.S. Pat. No. 5,271,990.

2. Optional Barrier Layer

The support may contain a barrier coating on one or both support surfaces. Any suitable barrier layer may be used. For instance, barrier layers may include, but are not limited to, the barrier layers disclosed in U.S. Pat. Nos. 6,410,200, 6,358,660, 5,501,902, 5,271,990, and 5,242,739, which are herein incorporated by reference.

Other suitable barrier layers include those disclosed in U.S. Pat. Nos. 4,021,591, 4,555,436, 4,657,557, 4,914,079, 4,927,709, 4,935,300, 5,322,833, 5,413,841, 5,679,461, 5,741,387, 5,798,179, and 5,603,966, all of which are herein incorporated by reference.

Lastly, suitable barrier layers include the barrier layers of U.S. Pat. Nos.4,773,953, 4,980,224, 5,620,548, 5,139,917, 5,236,801, 5,883,790, 6,245,710, 6,083,656, 5,948,586, 6,265,128, 6,033,824, 6,294,307, 6,410,200 and 6,358,660, and U.S. application Ser. Nos. 09/366,300, 09/547,760, 09/637,082, 09/828,134, 09/980,589, 09/453,881, 09/791,755, 10/089,446, and 10/205,628, and Provisional U.S. Application Ser. Nos. 60/396,632 and 60/304,752.

Coating weights for the barrier layer may range from one (1) gram per meter square to 20 grams per meter square, preferably from 1 $g/m^2$ to 15 $g/m^2$, most preferably 1 $g/m^2$ to 8 $g/m^2$.

3. The Web Layer

The web layer is formed from woven or non-woven synthetic fibers made from a polymer such as a polyester, rayon, nylon, polyolefin, polypropylene, polyethylene, or the like and blends thereof. The preferred fibers are those with high melt temperatures such as polyesters. An example of a preferred web layer is the Spunlace Grade SX-174 by Green Bay Nonwovens Corporation (Green Bay, Wis.). Other examples include the Signature, Miracle Dot and KF Series nonwoven web layers from Precision Custom Coating, LLC (Totowa, N.J.).

The fibers are formed into a continuous web by weaving to form a woven web. Alternatively, the fibers may be formed into a continuous non-woven web using common processes such as wet-laid, dry-laid, hydroentanglement (Spunlace), hydroneedle technique or extrusion. The formed fibers may be thermally bonded together. Thermal bonding may be achieved by such methods including a heated nip or pin process. The fibers may also be chemically bonded together with the use of binders such as acrylates. Other suitable binders will be discussed below. Other methods for forming continuous webs exist and are disclosed in U.S. Pat. Nos. 3,485,706, 4,188,690, 5,098,764, 6,315,864, 6,463,606, 6,465,378 and 6,502,288 which are herein incorporated by reference.

The weight of the formed web layer may affect the performance of the transfer material. This weight may range from 0.01 ounce to more than 5 ounces for each 8.5×11 sheet of uncoated/unimpregnated web layer. The weight of the web layer provides opacity and uniformity of the base.

The web layer designed to be capable of absorbing or taking on the image receiving formulation. In particular, the web layer is capable of absorbing from 1% to 200% by weight of the image receiving formulation based upon the unimpregnated weight of the web layer.

4. The Adhesion Layer

The adhesion layer is coated between the optional support and the web layer and keeps the two layers together during handling. Preferably, the adhesion layer has a slight tack which serves to hold the web layer on top of the optional support. That is, the adhesion layer preferably has sufficient tack to hold it onto the support. However, the tack must not be so strong as to permanently bond the adhesion layer to the support. The preferred tack would be similar to that found with an adhesive class of polymer coatings known as the removable pressure sensitive adhesives (e.g., having the tack prior to heating of a 3M "Post-It"). A removable pressure sensitive adhesive is characterized as an adhesive that allows two surfaces to be separated, reversibly, without damage to either surface. After printing/copying/drawing, the web sheet is peeled away from the optional support material. During the peeling process, the adhesion layer comes away with the web layer and will serve as the source of adhesion during the transfer upon the application of heat. The adhesion layer may either be coated to the web layer or to the support. The adhesion layer has a dry coat of about 2 to 40 g/m$^2$ and a thickness of 0.05 to 1.6 mil. A preferred dry coat weight would be 10-30 g/m$^2$; and, the most preferred coat weight would be 15-25 g/m$^2$.

Any polyester or acrylic polymer or copolymer blends may be used that exhibits a melt transition temperature in the range 50° C.-250° C., or when the glass transition temperature (Tg) of the polyolefin, polyester, polyurethane, acrylic polymer or copolymer blend is less than about 25 degrees Centigrade. Preferably, the Tg will fall between about 25° C. and 120° C. and display a slight tack when touched.

When the optional support is used, the surface energy difference between the selected support and the adhesion layer may be between about 0 to about 50 dynes/cm, preferably about 0 to about 30 dynes/cm, most preferably about 0 to about 15 dynes/cm.

In one embodiment of the invention, the adhesion layer comprises an ethylene acrylic acid co-polymer dispersion, an elastomeric emulsion, a polyurethane dispersion, and polyethylene glycol. An example of this embodiment is Adhesion Layer Formulation 1.

The acrylic dispersion is present in a sufficient amount so as to provide adhesion of the adhesion layer and image to the receptor element and is preferably present in an amount of from 46 to 90 weight %, more preferably 70 to 90 weight % based on the total composition of the adhesion layer.

The elastomeric emulsion provides the elastomeric properties such as mechanical stability, flexibility and stretchability, and is preferably present in an amount of from 1 to 45 weight %, more preferably 1 to 20 weight % based on the total composition of the adhesion layer.

The water repellent provides water resistance and repellency, which enhances the wear resistance and washability of the image on the receptor, and is preferably present in an amount of from 1 to 7 weight %, more preferably 3 to 6 weight % based on the total composition of the adhesion layer.

The plasticizer provides plasticity and antistatic properties to the transferred image, and is preferably present in an amount of from 1 to 8 weight %, more preferably 2 to 7 weight % based on the total composition of the adhesion layer.

Preferably, the acrylic dispersion is an ethylene acrylic acid co-polymer dispersion that is a film-forming binder that provides the "release" or "separation" from the support. The adhesion layer of the invention may utilize the film-forming binders of the image-receptive melt-transfer film layer of U.S. Pat. No. 5,242,739, which is herein incorporated by reference.

Thus, the nature of the film-forming binder is not known to be critical. That is, any film-forming binder can be employed so long as it meets the criteria specified herein. As a practical matter, water-dispersible ethylene-acrylic acid copolymers have been found to be especially effective film forming binders.

The term "melts" and variations thereof are used herein only in a qualitative sense and are not meant to refer to any particular test procedure. Reference herein to a melting temperature or range is meant only to indicate an approximate temperature or range at which a polymer or binder melts and flows under the conditions of a melt-transfer process to result in a substantially smooth film.

Manufacturers' published data regarding the melt behavior of polymers or binders correlate with the melting requirements described herein. It should be noted, however, that either a true melting point or a softening point may be given, depending on the nature of the material. For example, materials such as polyolefins and waxes, being composed mainly of linear polymeric molecules, generally melt over a relatively narrow temperature range since they are somewhat crystalline below the melting point.

Melting points, if not provided by the manufacturer, are readily determined by known methods such as differential scanning calorimetry. Many polymers, and especially copolymers, are amorphous because of branching in the polymer chains or the side-chain constituents. These materials begin to soften and flow more gradually as the temperature is increased. It is believed that the ring and ball softening point of such materials, as determined by ASTM E-28, is useful in predicting their behavior. Moreover, the melting points or softening points described are better indicators of performance than the chemical nature of the polymer or binder.

In another embodiment of the invention, the polymer may be applied to the web support in powder form, and then, heat is applied to form a coherent mass of the polymer on the web support. This process is often referred to in the textile industry as powder sintering. Any polyethylene, polyamide or blends thereof may be used in the process. Vestamelt 350, 432, 730, 732 and 750 (Degussa Corp.) are examples of a polyolefin polyamide blends with a typical melt transition temperature in the range of 105-130° C. Polyethylene powders are typically low density polyethylene (LDPE) compositions with a melt temperature in the range 50-250° C., preferably 70-190° C. and most preferably 80-150° C. LDPE examples include Microthene F501 (Equistar Chemical Co.) with a melt temperature of 104° C., and Icotex 520-5016 (Icopolymers Co.) with a melt temperature of 100° C.

Representative adhesion binders (i.e., acrylic dispersions) for release from the support are as follows:

Adhesion Binder A

Binder A is Michem® 58035, supplied by Michelman, Inc., Cincinnati, Ohio. This is a 35 percent solids dispersion of Allied Chemical's AC 580, which is approximately 10 percent acrylic acid and 90 percent ethylene. The polymer reportedly has a softening point of 102° C. and a Brookfield viscosity of 0.65 pas (650 centipoise) at 140° C.

Adhesion Binder B

This binder is Michem® Prime 4983R (Michelman, Inc., Cincinnati, Ohio). The binder is a 25 percent solids dispersion of Primacor® 5983 made by Dow Chemical Company. The polymer contains 20 percent acrylic acid and 80 percent ethylene. The copolymer has a Vicat softening point of 43° C. and a ring and ball softening point of 100° C. The melt index of the copolymer is 500 g/10 minutes (determined in accordance with ASTM D-1238).

Adhesion Binder C

Binder C is Michem® 4990 (Michelman, Inc., Cincinnati, Ohio). The material is 35 percent solids dispersion of Primacor® 5990 made by Dow Chemical Company. Primacor® 5990 is a copolymer of 20 percent acrylic acid and 80 percent ethylene. It is similar to Primacor® 5983 (see Binder B), except that the ring and ball softening point is 93° C. The copolymer has a melt index of 1,300 g/10 minutes and Vicat softening point of 39° C.

Adhesion Binder D

This binder is Michem® 37140, a 40 percent solids dispersion of a Hoechst-Celanese high density polyethylene. The polymer is reported to have a melting point of 100° C.

Adhesion Binder E

This binder is Michem® 32535 which is an emulsion of Allied Chemical Company's AC-325, a high density polyethylene. The melting point of the polymer is about 138° C. Michem® 32535 is supplied by Michelman, Inc., Cincinnati, Ohio.

Adhesion Binder F

Binder F is Michem® 48040, an emulsion of an Eastman Chemical Company microcrystalline wax having a melting point of 88° C. The supplier is Michelman, Inc., Cincinnati, Ohio.

Adhesion Binder G

Binder G is Michem® 73635M, an emulsion of an oxidized ethylene-based polymer. The melting point of the polymer is about 96° C. The hardness is about 4-6 Shore-D. The material is supplied by Michelman Inc., Cincinnati, Ohio.

The second component of Adhesion Layer Formulation 1 is an elastomeric emulsion, preferably a latex, and is compatible with the other components, and formulated to provide durability, mechanical stability, and a degree of softness and conformability to the layers.

Films of this material must have moisture resistance, low tack, durability, flexibility and softness, but with relative toughness and tensile strength. Further, the material should preferably have inherent heat and light stability. The latex can be heat sensitized, and the elastomer can be self-crosslinking or used with compatible cross-linking agents, or both. The latex should be sprayable, or roll stable for continuous runnability on nip rollers.

Elastomeric latexes of the preferred type are produced from the materials and processes set forth in U.S. Pat. Nos. 4,956,434 and 5,143,971, which are herein incorporated by reference. This curable latex is derived from a major amount of acrylate monomers such as $C_4$ to $C_8$ alkyl acrylate, preferably n-butyl acrylate, up to about 20 parts per hundred of total monomers of a monolefinically unsaturated dicarboxylic acid, most preferably itaconic acid, a small amount of crosslinking agent, preferably N-methyl acrylamide, and optionally another monolefinic monomer.

Using a modified semibatch process in which preferably the itaconic acid is fully charged initially to the reactor with the remaining monomers added over time, a latex of unique polymer architecture or morphology is created, leading to the unique rubbery properties of the cured films produced therefrom.

The third ingredient of Adhesion Layer Formulation 1 is a water resistant and adhesion aid such as a polyurethane dispersion. Preferably, the polyurethane will be a self-crosslinking formulation incorporating crosslinking agents such as melamine. This ingredient is also a softener for the acrylic dispersion and plasticizer aid.

Such polyurethane product may be produced by polymerizing one or more acrylate and other ethylenic monomers in the presence of an oligourethane to prepare oligourethane acrylate copolymers. The oligourethane is preferably prepared from diols and diisocyanates, the aliphatic or alicyclic based diisocyanates being preferred, with lesser amounts, if any, of aromatic diisocyanates, to avoid components which contribute to yellowing. Polymerizable monomers, in addition to the usual acrylate and methacrylate esters of aliphatic monoalcohols and styrene, further include monomers with carboxyl groups, such as acrylic acid or methacrylic acid, and those with other hydrophylic groups such as the hydroxyalkyl acrylates (hydroxyethyl methacrylate being exemplary). The hydrophylic groups in these monomers render the copolymer product dispersible in water with the aid of a neutralizing agent for the carboxyl groups, such as dimethylethanolamine, used in amount to at least partially neutralize the carboxyl groups after dispersion in water and vacuum distillation to remove any solvents used to prepare the urethane acrylic hybrid. Further formulations may include the addition of crosslinking components such as amino resins, strained amines or blocked polyisocyanates. Although pigments and fillers could be added to any of the coating layers, such use to uniformly tint or color the web could be used for special effect, but would not be used where an image is desired in the absence of background coloration. Urethane acrylic hybrid polymers are further described in U.S. Pat. No. 5,708,072, and their description in this application is incorporated by reference.

Self crosslinking acrylic polyurethane hybrid compositions can also be prepared by the processes and materials of U.S. Pat. No. 5,691,425, herein incorporated by reference. These are prepared by producing polyurethane macromonomers containing acid groups and lateral vinyl groups, optionally terminal vinyl groups, and hydroxyl, urethane, thiourethane and/or urea groups. Polymerization of these macromonomers produces acrylic polyurethane hybrids which can be dispersed in water and combined with crosslinking agents for solvent-free coating compositions.

Autocrosslinkable polyurethane-vinyl polymers are discussed in detail in U.S. Pat. Nos. 5,623,016 and 5,571,861, and their disclosure of these materials is incorporated by reference. The products usually are polyurethane-acrylic hybrids, but with self-crosslinking functions. These may be carboxylic acid containing, neutralized with, e.g. tertiary amines such as ethanolamine, and form useful adhesions and coatings from aqueous dispersion.

The elastomeric emulsion and polyurethane dispersion are, generally, thermoplastic elastomers. Thermoplastic elastomeric polymers are polymer blends and alloys which have both the properties of thermoplastic polymers, such as having melt flow and flow characteristics, and elastomers, which are typically polymers which cannot melt and flow due to covalent chemical crosslinking (vulcanization) or regions (blocks) of highly ordered polymeric units. Thermoplastic elastomers are generally synthesized using two or more monomers that are incompatible; for example, styrene and butadiene. By building long runs of polybutadiene with intermittent polystyrene runs, microdomains are established which imparts the elastomeric quality to the polymer system. However, since the microdomains are established through physical crosslinking mechanisms, they can be broken by application of added energy, such as heat from a hand iron, and caused to melt and flow; and therefore, are elastomers with thermoplastic quality.

Thermoplastic elastomers have been incorporated into the present invention in order to provide the image system with elastomeric quality. Two thermoplastic elastomer systems have been introduced; that is, a polyacrylate terpolymer elastomer (for example, Hystretch V-29) and an aliphatic urethane acryl hybrid (for example, Daotan VTW 1265). Thermoplastic elastomers can be chosen from a group that includes, for example, ether-ester, olefinic, polyether, polyester and styrenic thermoplastic polymer systems. Specific examples include, by way of illustration, thermoplastic elastomers such as polybutadiene, polybutadiene derivatives, polyurethane, polyurethane derivatives, styrene-butadiene, styrene-butadiene-styrene, acrylonitrile-butadiene, acrylonitrile-butadiene-styrene, acrylonitrile-ethylene-styrene, polyacrylates, polychloroprene, ethylene-vinyl acetate and poly (vinyl chloride). Generally, thermoplastic elastomers can be selected from a group having a glass transition temperature (Tg) ranging from about −50° C. to about 25° C.

The fourth component of Adhesion Layer Formulation 1 is a plasticizer such as a polyethylene glycol dispersion which provides mechanical stability, water repellency, and allows for a uniform, crack-free film. Accordingly, a reason to add the polyethylene glycol dispersion is an aid in the coating process. Further, the polyethylene glycol dispersion acts as a softening agent. A preferred fourth component is Carbowax Polyethylene Glycol 400, available from Union Carbide.

An optional fifth ingredient of Adhesion Layer Formulation 1 is a surfactant and wetting agent such as polyethylene glycol mono ((tetramethylbutyl) phenol) ether. Alternatively, the representative binders, described above that are suitable for Adhesion Layer Formulation 1, may be used in lieu of the above-described ethylene acrylic acid copolymer dispersion.

In a preferred embodiment, the adhesion layer is composed of a crosslinking polymer, for example, polyurethane or polyethylene. When heat is applied to the adhesion layer, it bonds to the receptor element. The bond created is durable to washing, dry-cleaning, and is durable under mechanical stress.

Other adhesion layers may also be used according to the present invention. For instance, suitable adhesion layer formulations include those formulations for adhesion layers and melt transfer layers disclosed in U.S. Pat. Nos. 6,410,200, 6,358,660, 5,501,902, 5,271,990, 5,242,739, 4,021,591, 4,555,436, 4,657,557, 4,914,079, 4,927,709, 4,935,300, 5,322,833, 5,413,841, 5,679,461, 5,741,387, 5,798,179, 5,603,966, 4,773,953, 4,980,224, 5,620,548, 5,139,917, 5,236,801, 5,883,790, 6,245,710, 6,083,656, 5,948,586, 6,265,128, 6,033,824, 6,294,307, 6,410,200 and 6,358,660, and U.S. application Ser. Nos. 09/366,300, 09/547,760, 09/637,082, 09/828,134, 09/980,589, 09/453,881, 09/791,755, 10/089,446, and 10/205,628, and Provisional U.S. Application Ser. Nos. 60/396,632 and 60/304,752.

5. Optional Antistatic Layer

An antistatic layer may be coated on the back of the optional support opposite the adhesion layer. Any suitable antistatic layer known in the art may be used as the antistatic layer of the present invention. In accordance with one embodiment of the invention, the support is usable in a laser copier or laser printer. A preferred support for this embodiment is equal to or less than approximately 4.0 mils thick. The antistatic layer according to the present invention may have a solution viscosity of from 0.1 to 20 cP, preferably 1-5 cP, most preferably about 2 cP, as measured on a Brookfield DV-I+ viscometer, LV1 spindle at 60 rpm at a temperature of 25° C. Additionally, the antistatic layer may be wet coated in an amount of from 1 $g/m^2$ to 50 $g/m^2$, preferably from 10-30 $g/m^2$, most preferably about 18 $g/m^2$. The surface tension of the antistatic layer may be from 30-110 dynes/cm, preferably from 50-90 dynes/cm, most preferably about 70 dynes/cm as measured at room temperature.

Since the support is useable in a laser copier or laser printer, antistatic agents may be present. The antistatic agents may be present in the form of a coating on the back surface of the support as an additional layer. The back surface of the support is the surface that is not previously coated with the adhesion layer.

When the antistatic agent is applied as a coating onto the back surface of the support, the coating will help eliminate copier or printer jamming by preventing the electrostatic adhesion of the paper base to the copier drum of laser and electrostatic copiers and printers. Antistatic agents, or "antistats" are generally, but not necessarily, conductive polymers that promote the flow of charge away from the paper. Antistats can also be "humectants" that modulate the level of moisture in a paper coating that affects the build up of charge. Antistats are commonly charged tallow ammonium compounds and complexes, but also can be complexed organometallics. Antistats may also be charged polymers that have a similar charge polarity as the copier/printer drum; whereby the like charge repulsion helps prevent jamming.

Antistatic agents include, by way of illustration, derivatives of propylene glycol, ethylene oxide-propylene oxide block copolymers, organometallic complexes such as titanium dimethylacrylate oxyacetate, polyoxyethylene oxide-polyoxypropylene oxide copolymers and derivatives of cholic acid.

More specifically, commonly used antistats include those listed in the *Handbook of Paint and Coating Raw Materials*, such as t-Butylaminoethyl methacrylate; Capryl hydroxyethyl imidazoline; Cetethyl morpholinium ethosulfate; Cocoyl hydroxyethyl imidazoline Di (butyl, methyl pyrophosphato) ethylenetitanate di (dioctyl, hydrogen phosphite); Dicyclo (dioctyl)pyrophosphato; titanate; Di (dioctylphosphato) ethylene titanate; Dimethyl diallyl ammonium chloride; Distearyldimonium chloride; N,N'-Ethylene bis-ricinoleamide; Glyceryl mono/dioleate; Glyceryl oleate; Glyceryl stearate; Heptadecenyl hydroxyethyl imidazoline; Hexyl phosphate; N(β-Hydroxyethyl) ricinoleamide; N-(2-Hydroxypropyl) benzenesulfonamide; Isopropyl4-aminobenzenesulfonyl di (dodecylbenzenesulfonyl) titanate; Isopropyl dimethacryl isostearoyl titanate; isopropyltri (dioctylphosphato) titanate; Isopropyl tri (dioctylpyrophosphato) titanate; Isopropyl tri (N ethylaminoethylamino) titanate; (3-Lauramidopropyl) trimethyl ammonium methyl sulfate; Nonyl nonoxynol-15; Oleyl hydroxyethylimidazoline; Palmitic/stearic acid mono/diglycerides; PCA; PEG-36 castor oil; PEG-10 cocamine; PEG-2 laurate; PEG-2; tallowamine; PEG-5 tallowamine; PEG-15 tallowamine; PEG-20 tallowamine; Poloxamer 101; Poloxamer 108; Poloxamer 123; Poloxamer 124; Poloxamer 181; Poloxamer 182; Poloxamer 184; Poloxamer 185; Poloxamer 188; Poloxamer 217; Poloxamer 231; Poloxamer 234; Poloxamer 235; Poloxamer 237; Poloxamer 282; Poloxamer 288; Poloxamer 331; Polaxamer 333; Poloxamer 334; Poloxamer 335; Poloxamer 338; Poloxamer 401; Poloxamer 402; Poloxamer 403; Poloxamer 407; Poloxamine 304; Poloxamine 701; Poloxamine 704; Polaxamine 901; Poloxamine 904; Poloxamine 908; Poloxamine 1107; Poloxamine 1307; Polyamide/epichlorohydrin polymer; Polyglyceryl-10 tetraoleate; Propylene glycol laurate; Propylene glycol myristate; PVM/MA copolymer; polyether; Quaternium-18; Slearamidopropyl dimethyl-β-hydroxyethyl ammonium dihydrogen phosphate; Stearamidopropyl dimethyl-2-hydroxyethyl ammonium nitrate; Sulfated peanut oil; Tetra (2, diallyoxymethyl-1 butoxy titanium di (di-tridecyl) phosphite; Tetrahydroxypropyl ethylenediamine; Tetraisopropyl di (dioctylphosphito) titanate; Tetraoctyloxytitanium di (ditridecylphosphite); Titanium di (butyl, octyl pyrophosphate) di (dioctyl, hydrogen phosphite) oxyacetate; Titanium di (cumylphenylate) oxyacetate; Titanium di (dioctylpyrophosphate) oxyacetate; Titanium dimethacrylate oxyacetate.

Preferably, Marklear AFL-23 or Markstat AL-14, polyethers available from Whitco Industries, are used as an antistatic agents.

The antistatic coating may be applied on the back surface of the support by, for example, spreading a solution comprising an antistatic agent (i.e., with a metering rod) onto the back surface of the support and then drying the support.

An example of one support of the present invention is Georgia Pacific brand Microprint Laser Paper. However, any non-woven cellulosic or film support may be used as the support in the present invention.

6. Optional Opaque Layer(s)

The present material may optionally contain one or more opaque layers, for instance the opaque layers described in pending U.S. Pat. application Ser. Nos. 10/089,446 and 10/483,387. In the present invention, the optional opaque layer(s) is placed between the adhesion layer and the web layer.

The optional opaque layer(s) adds a rigid or stiff quality to the transfer sheet for ease of handling, as well as having opacity, especially white, to enhance visibility of the image when placed thereon. That is, the opaque layer(s) aid in ink visibility on various colored receptors.

6.1 Opaque Layer A

When one or more opaque layers are employed, the opaque layer provides additional background contrast for the applied image to render it visible against, for instance a dark or a light receptor. The opaque layer(s) improves the appearance and readability of an image, such as, for instance, a bar code or a color image.

When permanently adhering the image material to a textile, the opaque layer(s) layers preferably will be thermoplastic and optionally thermosetting as they are applied to a porous substrate such as a fabric. When a thermosettable formulation is employed for the opaque layers, the image fused into the fabric will have the maximum resistance to washing or dry cleaning.

The first optional opaque layer (Opaque layer A) adds a rigid or stiff quality to the entire heat-setting label sheet for ease of handling, as well as having a white (or colored) opacity. Any pigmented resin may be used to achieve the desired outcome.

A preferred embodiment of opaque layer A, Opaque Layer formulation 1 comprises styrene-butadiene latex, thermoplastic elastomer, an elastomer and an optional pigment.

All the above chemicals form a homogeneous dispersion aided by a stir bar at a low to medium stir rate. All mixing can be done at room temperature. After coating, the preferred thickness of Opaque Layer A is about 1.5 mils (wet).

In the above-described preferred embodiment, a pigment such as a white pigment may be used to exhibit opacity capabilities. Also in the preferred embodiment, the latex is the primary chemical imparting the rigid characteristics upon drying. The thermoplastic elastomer and acrylonic copolymer impart stretchability and flexibility in the final transferred product.

6.2 Opaque Layer B

The optional Opaque Layer B preferably contains a pigment (such as a white pigment) and provides opacity. A preferred embodiment of the optional opaque layer B. Opaque Layer Formulation 1, comprises a vinyl acetate-ethylene copolymer, thermoplastic elastomer, an elastomer and an optional pigment such as $TiO_2$.

The thermoplastic elastomer acrylonitrile copolymer impart stretchability and flexibility in the final transferred product. Practically any $TiO_2$ powder addition, present at about 25% of the total formula, will provide the desired opacity. Other powdered pigments may need to be added at varying percentages to achieve the desired opacity and color intensity.

All liquid chemicals are homogenized in the presence of a stir bar and a low speed. Upon homogenization, the pigment powder is added slowly in the presence of a high stir speed provide by a stir flea. All mixing of the above ingredients should be performed at room temperature. Preferably, optional Opaque Layer B is coated on the heat setting label sheet at a weight of about 1.0 to 1.5 mils (wet).

7. The Image Receiving Formulation

An image receiving formulation is applied over the top surface of the web layer. The image receiving formulation may also be applied by saturating the woven or non-woven material through a dunk and squeeze method. This creates a web layer that is impregnated with the image receiving formulation. The image receiving formulations of the present invention should be able to retain an image such as an image dye. The image receiving layer retains dyes, such as ink from ink jet printers, or dyes from a waterbased marker. If an ink jet ink is utilized, the image preferably has comparable resolution to standard ink jet paper. In one embodiment, the image receiving formulation may become heat activated (e.g. melt and flow) to trap or encapsulate the dye image or ink and optionally impart waterfast characteristics. The image receiving formulation also imparts washability characteristics.

The image receiving formulation may be applied to the web layer either by a conventional saturating process such as a "dip and squeeze" process or with a coating process such as a reverse roll, meyer rod, gravure, slot die and the like.

The image receiving formulation is added to the web in an optimum amount measured as a percent add-on based on the weight of the web layer. The add-on may be as low as 1% or as high as 200% based upon the uncoated weight of the web layer. The add-on is the amount of formulation added to the web layer relative to the web layer weight. For instance, if the web weighed one ounce and the final weight after saturation is 3 oz, then the add-on is 200%. The amount of the add-on is determined by measuring printability, image quality, durability in a wash, color retention in a wash, softness, and hand.

The image receiving formulation that is impregnated into the web layer or coated on the web layer is capable of heat sealing the image upon application of heat up to 220° C. "Heat sealing" as defined herein refers to a process whereby the polymer composition encapsulates the image forming colorants therein. A heat sealed image would have newly imparted image permanence properties such as waterfastness and rub resistance.

In one embodiment, the image receiving formulation includes a self-crosslinking polymer as a binder. In this embodiment, although not all components of the image receiving layer will technically melt, for instance, the self-cross linking EVA polymer will not melt, the layer will still heat seal the image.

The image receiving formulation comprises binders, such as polyvinyl alcohol (PVOH), polyesters, polyurethanes, or co-polymer blends, various colorant retention aids, various optional crosslinking agents, an optional antioxidant, or an optional softening agent.

The binder imparts colorant retention and mechanical stability. A list of applicable binders include, but are not limited to, those listed in U.S. Pat. No. 5,798,179, in addition to polyolefins, polyesters, ethylene-vinyl acetate copolymers, ethylene-methacrylate acid copolymers, and ethylene-acrylic acid copolymers. The binder may also be selected from the list, mentioned herein, for use in the adhesion layer.

Preferably, the binders is one of a self-crosslinkable acrylic copolymer, for instance, Rhoplex™ NW-1402, Rhoplex™ HA-16 or Rhoplex™ HA-12 from the Rohm and Haas Corporation, or a hydrolyzed polyvinyl alcohol, for instance, Celvol™ 540 or Celvol™ 125, from the Celanese Corporation, or a self-crosslinking ethylene-vinyl acetate copolymer, for instance, Dur-o-set™ Elite Plus 25-299A, from National Starch, now Vinamul Polymers Corp.

An antioxidant is added to keep the binder from discoloring (yellowing) during the heat process. Suitable antioxidants include, but are not limited to, BHA; Bis (2,4-di-t-butylphenyl) pentaerythritol diphosphite; 4,4'-Butylidenebis (6-t-butyl-m-cresol), C20-40 alcohols; p-Crescol/dicyclopentadiene butylated reaction product, Di (butyl, methyl pyrophosphato) ethylene titanate di (dioctyl, hydrogen phosphite); Dicyclo (dioctyl) pyrophosphato titanate; Di (dioctylphosphato) ethylene titanate; Di (dioctylpyrophosphato) ethylene titanate; Disobutyl nonyl phenol; Dimethylaminomethyl phenol, Ethylhydroxymethyloleyl oxazoline Isopropyl 4aminobenzenesulfonyl di (dodecylbenzenesulfonyl) titanate; Isopropyldimethacrylisoslearoyl titanate; Isopropyl (dioctylphosphato) titanate; isopropyltridioctylpyrophosphato) titanate; Isopropyl tri (N ethylamino-ethylamino) titanate, Lead phthalate, basic 2,2-Methylenebis (6-t-butyl-4-methylphenol), Octadecyl 3,5-di-t-butyl-4-hydroxyhydrocinnamate Phosphorus; Phosphorus tnchloride, reaction prods. with 1,1'-biphenyl and 2,4-bis (1,1-dimethylethyl) phenol Tetra (2, diallyoxymethyl-1 butoxy titanium di (ditridecyl) phosphite; Tetraisopropyl di (dioctylphosphito) titanate; Tetrakis [methylene (3,5-di-t-butyl-4-hydroxyhydrocinnamate)] methane; Tetraoctyloxytitanium; di (ditridecylphosphite); 4,4'-Thiobis-6-(t-butyl-m-cresol); Titanium di (butyl, octyl pyrophosphate) di (diocLyl, hydrogen phosphite) oxyacetate; Titanium di (cumylphenylate) oxyacetate; Titanium di (dioctylpyrophosphate), oxyacelate; Titanium dimethyacrylate oxyacetate; 2,2,4-Trimethyl-1,2-dihydroquinoline polymer; Tris (nonylphenyl) phosphite. Preferably, the antioxidant used is octadecyl 3,5-Ditert-butyl-4-hydroxyhydrocinnamate.

Representative image receiving formulation binders suitable to impart color retention and mechanical stability include:

Image Receiving Formulation Binder A

Image receiving formulation Binder A is Rhoplex NW-1402, a self-crosslinkable acrylic copolymer from the Rohm and Haas Corporation. This material is a 45% solids formulation with a specific gravity of 1.0 to 1.2.

Image Receiving Formulation Binder B

Image receiving formulation Binder B is Rhoplex HA-16, a self-crosslinkable acrylic copolymer from the Rohm and Haas Corporation. This material is a 46% solids formulation with a maximum viscosity of 900 CPS.

Image Receiving Formulation Binder C

Image receiving formulation Binder C is Rhoplex HA-12, a self-crosslinkable acrylic copolymer from the Rohm and Haas Corporation. This material is a 46% solids formulation with a maximum viscosity of 750 CPS.

Image Receiving Formulation Binder D

Image receiving formulation Binder D is Celvol 540, a partially hydrolyzed polyvinyl alcohol from the Celanese Corporation.

Image Receiving Formulation Binder E

Image receiving formulation Binder E is Celvol 125, a hydrolyzed polyvinyl alcohol from the Celanese Corporation.

Image Receiving Formulation Binder F

Image receiving formulation Binder F is Dur-o-set 25-299A, a self-crosslinking EVA copolymer from Vinamul Polymers Corp. This materials is prepared as a 50% solids emulsion with a bulk density of 8.9 lb/gal.

An optional crosslinking agent can be added to each formula to crosslink the binder to improve waterfastness. Crosslinkers suited for this application including, but not limited to, aziridine (ie., Ionac PFAZ-322), aziridine derivatives, multifunctional aziridines (XAMA-7 (Sybron)) Sancure 777 (Noveon), and melamine (ie., Cymul 323 EvCo, Inc.), and organometallics like an organic titanate such as Tyzor LA (DuPont).

In an embodiment where web is marked with a laser copier or printer, image receiving formulation may comprise at least one film-forming binder selected from the group consisting of ethylene-acrylic acid copolymers, polyolefins, and waxes. A preferred binder, especially when a laser copier or laser printer is used in accordance with this invention is an ethylene acrylic acid co-polymer dispersion. Such a dispersion is represented by Image receiving Formulation 4.

In another embodiment of the invention, when an ink jet printer is used in accordance with the present invention, the image receiving formulation may utilize the materials of the fourth layer of U.S. Pat. No. 5,798,179. Thus, for practicing the present invention using an ink jet printer, the image receiving formulation may comprise particles of a thermoplastic polymer having largest dimensions of less than about 50 micrometers. Preferably, the particles will have largest dimensions of less than about 50 micrometers. More preferably, the particles will have largest dimensions of less than about 20 micrometers. In general, the thermoplastic polymer may be any thermoplastic polymer which meets the criteria set forth herein. Desirably, the powdered thermoplastic polymer will be selected from the group consisting of polyolefins, polyesters, polyamides, and ethylene-vinyl acetate copolymers.

The image receiving formulation may also include from about 10 to about 50 weight percent of a film-forming binder, based on the weight of the thermoplastic polymer. Desirably, the amount of binder will be from about 10 to about 30 weight percent. In general, any film-forming binder may be employed which meets the criteria set forth herein. When the image receiving formulation includes a cationic polymer as described below, a nonionic or cationic dispersion or solution may be employed as the binder. Suitable binders include polyacrylates, polyethylenes, and ethylene-vinyl acetate copolymers. The latter are particularly desired because of their stability in the presence of cationic polymers. The binder desirably will be heat softenable at temperatures of about 120° C. or lower.

The image receiving formulation may contain from about 2 to about 20 weight percent of a cationic polymer, based on the weight of the thermoplastic polymer. The cationic polymer may be, for example, an amide-epichlorohydrin polymer, polyacrylamides with cationic functional groups, polyethyleneimines, polydiallylamines, and the like.

Representative cationic polymers used as a dye retention aid include:

Cationic Polymer A

Cationic Polymer A is APC-M1, a polydiallylmethylamine hydrochloride resin from Advanced Polymers, Inc. APC-M1 is a 60% solids dispersion in water with a molecular weight of 20,000.

Cationic Polymer B

Cationic Polymer B is APC-J81, a dimethyldiallylammonium chloride/acrylamide copolymer from Advanced Polymers, Inc. APC-J81 is a 25% solids dispersion in water with a molecular weight of 200,000.

Cationic Polymer C

Cationic Polymer C is APC-A1, a dimethyldiallylammonium chloride/sulfur dioxide copolymer from Advanced Polymers, Inc. APC-A1 is a 24% solids dispersion in water with a molecular weight of 5,000.

Cationic Polymer D

Cationic Polymer D is CP 7091 RV, a poly (diallyldimethylammonium chloride-co-diacetone acrylamide) from ECC International.

When a cationic polymer is present, a compatible binder should be selected, such as a nonionic or cationic dispersion or solution. As is well known in the paper coating art, many commercially available binders have anionically charged particles or polymer molecules. These materials are generally not compatible with the cationic polymer which may be used in the image receiving layer.

The image receiving formulation may contain the addition of filler agents with the purpose of opacifying and modulating the surface characteristics of the present invention. The surface roughness and coefficient of friction may need to be modulated depending on such factors as desired surface gloss and the imaging device's specific paper feeding requirements. The filler can be selected from a group of polymers such as, for example, polyacrylates, polyacrylics, polyethylene, polyethylene acrylic copolymers and polyethylene acrylate copolymers, vinyl acetate copolymers and polyvinyl polymer blends that have various particle dimensions and shapes. Typical particle sizes may range from 0.1 to 500 microns. Preferably, the particle sizes range from 5 to 100 microns. More preferably, the particle sizes range from 5 to 30 microns. The filler may also be selected from a group of polymers such as, for example, cellulose, hydroxycellulose, starch and dextran. Silicas and mica may also be selected as a filler. The filler is homogeneously dispersed in the image receiving layer in concentrations ranging from 0.1 to 50%. Preferably, the filler concentration range is 1 to 10 percent. The filler may also be an inorganic pigment such as titanium dioxide.

In one embodiment of the present invention, the image receiving formulation contains a self-crosslinkable polymer binder. When present, the self-crosslinkable polymer binder is preferably present in an amount, based on the dry solids content, of 15-40%, and most preferably 25-35% by weight. In this embodiment, the self-crosslinkable polymer binder is preferably a thermosetting polymer such as a self-crosslinking ethylene vinyl acetate copolymer (for instance, Dur-o-set™ Elite Plus 25-299A, from Vinamul Polymers Corp.). Other suitable self-crosslinkable polymer includes those listed above.

When a self-crosslinkable polymer binder is present, the image receiving formulation may also include a thermoplastic polymer binder. For instance, thermoplastic binders, such as those listed above may be incorporated in amounts of 5-40%, preferably 10-30% by weight based on the dry solids content.

The self-crosslinkable polymer binder-containing image receiving formulation may further include dye retention aids such as the cationic polymers listed above. These cationic polymers may be incorporated in amounts of 1-10% by weight, preferably 1-4% by weight based upon the dry solids content. Other dye retention aids may include any salt with dissociative properties. Exemplary, but non-limitive examples include salts with Group II elements such as Mg, CA, Sr or Ba, or other elements such as Al, Zn, and Cu. Preferably $CaCl_2$ may be utilized as a dye retention aid. The salt with dissociative properties may be present in amounts of 0.25-4%, preferably 1-2% by weight based upon the dry weight of the formulation.

The formulation may also include polyamide copolymers, for instance nylon 6-12 (Orgasol™ 3501 EXDNAT 1, from Atofina), nylon 12 (Orgasol 2002 EXDNAT 1, from Atofina), and nylon 6 (Orgasol 1002 DNAT1, from Atofina). The formulation may also include a polyvinylpyrrolidone (PVP) polymer and copolymer blends for instance, Luvicross (BASF), Luvicross M (BASF), Luvicross VI (a PVP-vinyl imidazole copolymer blend (BASF)), and Luvitec (BASF). The polyamide copolymers may be incorporated in amounts of 5-40%, preferably 10-30% by weight based upon the dry solids of the formulation.

Silica may also be added to the image receiving layer which contains the self-crosslinkable polymer binder. Silica is silicon dioxide, and can generally be any preparation that has a mean diameter not larger than 100 microns. Examples include the Syloid brand of silica (such as Syloid W-500, from Grace Davidson Co.), Sylojet brand of silica (such as the Sylojet P400, Grace Davidson Co.), INEOS silica (such as the Gasil HP270 or Gasil IJ45). Silica may be added in amounts ranging from 5-60%, preferably 10-40%, most preferably 15-35% by weight based on the dry solids content.

B. Application of Layers

The various layers of the transfer material are formed by known coating techniques, such as by curtain coating, Meyer rod, roll, blade, air knife, cascade and gravure coating procedures.

In referring to FIG. 1, there is generally illustrated a cross-sectional view of one embodiment of the transfer sheet of the present invention. The support 21 comprises a top and bottom surface. On the top surface of the support is the web layer 23. The web layer is impregnated with an image receiving formulation 24. Between the support material and the web layer is the adhesion layer 22. The image 26 is placed over the web layer on the side opposite the support material. An optional anti-static 25 layer may be coated on the bottom surface of the support material 21.

C. Receptor Element

The receptor or receiving element receives the transferred image. A suitable receptor includes but is not limited to textiles including cotton fabric, and cotton blend fabric. The receptor element may also include glass, metal, wool, plastic, ceramic or any other suitable receptor. Preferably the receptor element is a tee shirt or the like.

The image, as defined in the present application may be applied in any desired manner. For example, the image may be formed by a color or monochrome laser printer, laser copier, bubblejet printer, inkjet printer, and the like. The image may also be applied using commercial printing methods such as sheet-fed offset, screen and gravure printing methods.

To transfer the image, several alternatives exist. For instance, the impregnated web layer (web layer impregnated with image receiving formulation) or web layer coated with the image receiving formulation may be first imaged. Then, if a support is present, the imaged impregnated web layer (or imaged web layer with image receiving formulation coat) and adhesion layer are peeled away from the support material and placed preferably image side up, adhesion layer down, against a receptor element.

Alternatively, the impregnated web layer and adhesion layer (or web layer with image receiving formulation coated thereon, and the adhesion layer) may be first peeled away from the support layer. Then, the impregnated web layer or coated image receiving formulation may be imaged. If a support layer is not present, there is no need to first peel the web layer and adhesion layer. Then, the imaged web layer or image receiving formulation and adhesion layer are placed preferably image side up, adhesion layer down, against a receptor element.

Alternatively, imaging step can wait until after the impregnated web layer (or web layer and coated image receiving formulation) and adhesion layer are placed upon the receptor. In this alternative, the impregnated web layer (or web layer and coated image receiving formulation) and adhesion layer are preferably placed adhesion layer down.

Alternatively, after an imaged impregnated web layer or imaged web layer with image receiving formulation coating, and adhesion layer are placed upon the receptor, additional imaging may occur.

After the impregnated web layer, and/or web layer with coating of image receiving formulation and adhesion layer are placed on the receptor, whether they are imaged or not, the next step is that a heat source, for instance a hand iron, a heat press or an oven is used to apply heat to the top imaged surface which in turn releases the image. If a hand iron or heat press is used that is not made of a tack-free material (such that the imaged web layer will stick thereto), a non-stick sheet should be placed between the heat source and the imaged web layer. However, even if the heat source, be it a hand iron or heat press, is made of a tack-free material, a non-stick sheet may still be placed between the heat source and the imaged web layer.

Alternatively, heat may be applied to the back surface of the receptor element. In this alternative there is no need for a tack-free sheet regardless of the heat source used.

The temperature transfer range of the hand iron is generally in the range of 110 to 220° C. with about 190° C. being the preferred temperature. The heat press operates at a temperature transfer range of 100 to 220° C. with about 190° C. being the preferred temperature. Lastly, if a conventional oven is used, the temperature should be set within the range of 110 to 220° C. with about 190° C. being the preferred temperature In the hand iron or heat press transfer, the heat source is preferably placed over the imaged side of the imaged web layer. However, as indicated above, the hand iron or heat press may be applied to the side of the receptor element opposite the web layer. With a hand iron, the iron is preferably moved in a circular motion. Pressure (i.e., typical pressure applied during ironing) should be applied as the heating device is moved over the support (see FIG. 2). For a 8.5×11 (US Letter) inch web, heat is applied for about two minutes to five minutes (with about three minutes being preferred) using a hand iron and 10 seconds to 50 seconds using a heat press (with about twenty seconds being preferred) of heat and pressure, the transfer should be complete. The heating time requirement may be proportionally shorter or longer depending on the web size. The optional non-stick sheet is removed either prior to cooling or after cooling. The non-stick sheet is not required if the heating device is made of a non-stick material.

Figure 2:
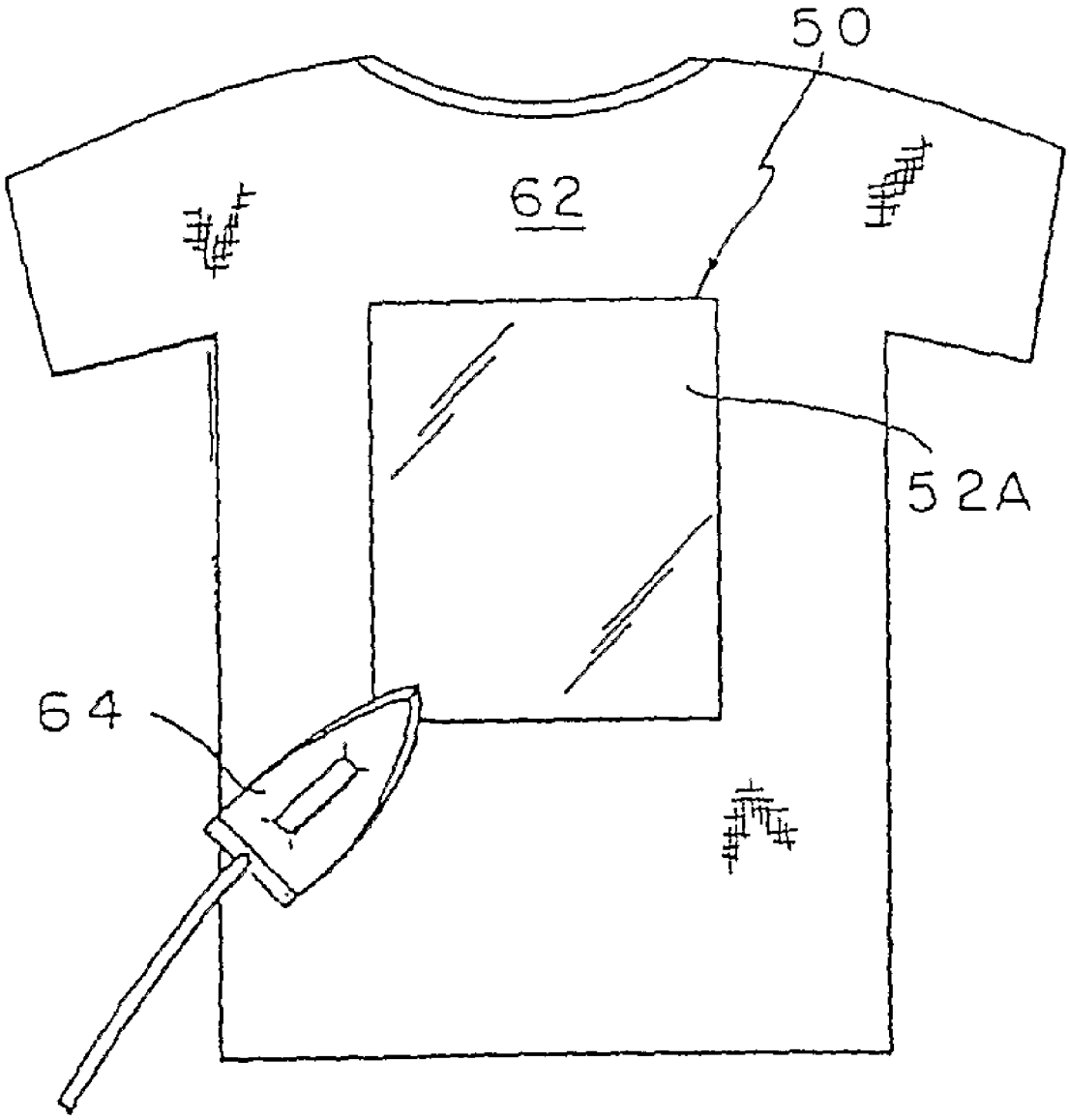

Referring to FIG. 2, the method of applying an image to a receptor element will be described. More specifically, FIG. 2 illustrates how the step of heat transfer from the transfer sheet 50 to a tee shirt or fabric 62 may be performed. A tee shirt 62 is laid flat, as illustrated, on an appropriate support surface, and the optionally imaged surface of the peeled imaged web layer is preferably positioned up and away from the tee shirt. A non-stick layer is then placed on top of the imaged web layer. An iron 64 set at its highest heat setting is run and pressed across the non-stick sheet. The image is transferred to the tee shirt and the non-stick sheet is removed and discarded or saved for reuse. The non-stick sheet is not required if the heating device is made of a non-stick material.

The non-stick sheet is any non-stick or tack-free sheet in the art including but not limited to a silicone sheet, a sheet coated with a barrier layer according to the present invention, or a substrate or support sheet.

In a preferred embodiment, the method of ironing as described in U.S. Pat. No. 6,539,652, which is herein incorporated by reference, can be used.

The following examples are provided for a further understanding of the invention, however, the invention is not to be construed as limited thereto.

EXAMPLES

Example 1

In one embodiment of the invention, the adhesion layer is an ethylene acrylic acid co-polymer. An example of this embodiment is Adhesion Layer Formulation 1:

Adhesion Layer Formulation 1

| Components | Parts by weight |
|---|---|
| Ethylene Acrylic Acid Co-polymer Dispersion (Michem Prime 4983R, Michelman) | 86 parts |
| Elastomeric emulsion (Hystretch V-29, BFGoodrich) | 5 parts |
| Polyurethane Dispersion (Daotan VTW 1265, Vianova Resins) | 4 parts |
| Polyethylene Glycol (Carbowax Polyethylene Glycol 400, Union Carbide) | 4 parts |
| Polyethylene Glycol Mono ((Tetramethylbutyl) Phenol) Ether (Triton X-100, Union Carbide) | 1 part |

Adhesion Layer Formulation 1, as an embodiment of the invention suitable for at least laser copiers and laser printers, is wax free. Adhesion Layer Formulation 1 may be prepared as follows: five parts of the elastomer dispersion are combined with eighty-six parts of an ethylene acrylic acid co-polymers dispersion by gentle stirring to avoid cavitation. Four parts of a polyurethane dispersion are then added to the mixture. Immediately following the addition of a polyurethane dispersion, four parts of a polyethylene glycol and one part of an nonionic surfactant (e.g., Triton X-100) are added. The entire mixture is allowed to stir for approximately fifteen minutes at a moderate stir rate (up to but not exceeding a rate where cavitation occurs).

Example 2

This example relates to another adhesion layer formulation, Adhesion Layer Formulation 2.

Adhesion layer Formulation 2

| Components | Parts |
|---|---|
| Ethylene Acrylic Acid Co-polymers dispersion (Michem Prime 4938R, Michelman) | 74 parts(weight) |
| Wax Dispersion (Michelman 73635M, Michelman) | 25 parts(weight) |

Adhesion Layer Formulation 2 may be prepared in the following manner: the ethylene acrylic acid co-polymer dispersion and the wax dispersion are stirred (for example in a beaker with a stirring bar).

Example 3

This example relates to another adhesion layer formulation, Adhesion Layer Formulation 3.

Adhesion Layer Formulation 3

| Components | Parts |
|---|---|
| Heat-activated Polyurethane Dispersion (Neorez R-551 (Avecia Co.) | 100 Parts |

Example 4

This example relates to another adhesion layer formulation, Adhesion Layer Formulation 4.

Adhesion Layer Formulation 4

| Components | Parts |
|---|---|
| Polyolefin-polyamide Copolymer (Vestamelt 432 (Degussa Co.) | 100 Parts |

Adhesion Layer Formulation 4 may be prepared by applying the copolymer powder to the web support under a sintering temperature of 200° C. The final dry basis weight was 20 $g/m^2$.

Example 5

This example relates to another adhesion layer formulation, Adhesion Layer Formulation 5.

Adhesion Layer Formulation 5

| Components | Parts |
|---|---|
| Polyethylene Powder (Icotex 520-5016 (Icopolymers Co.) | 100 Parts |

Adhesion Layer Formulation 5 may be prepared by applying the polyethylene powder to the web support under a sintering temperature of 200° C. The final dry basis weight was 20 $g/m^2$.

Example 6

This example relates to an image receiving layer formulation, Image receiving Formulation 1.

Image receiving Formulation 1

| Components | Parts |
|---|---|
| Ethylene Acrylic Copolymer(Rhoplex NW-1402 (Rohm and Haas)) | 95 Parts |
| Cationic Polymer (APC-M1, Advanced Polymers, Inc.) | 5 Parts |

Image receiving Formulation 1 may be prepared by mixing 5 parts cationic polymer dispersion to 95 parts ethylene acrylic co-polymer dispersion by gentle stirring.

Example 7

This example relates to another image receiving formulation, Image receiving layer Formulation 2.

| Image receiving Formulation 2 | |
|---|---|
| Components | Parts |
| Ethylene Acrylic Copolymer(Rhoplex NW-1402 (Rohm and Haas)) | 92 Parts |
| Cationic Polymer (APC-J81, Advanced Polymers, Inc.) | 8 Parts |

Image receiving Formulation 2 may be prepared by mixing 8 parts cationic polymer dispersion to 92 parts ethylene acrylic co-polymer dispersion by gentle stirring.

Example 8

This example relates to another image receiving formulation, Image receiving Formulation 3

| Image receiving Formulation 3 | |
|---|---|
| Components | Parts |
| Ethylene Acrylic Copolymer(Rhoplex NW-1402 (Rohm and Haas)) | 60 Parts |
| Polyethylene Wax (Michem Emulsion 58035, (Michelman, Inc.) | 37 Parts |
| Cationic Polymer (APC-J81, Advanced Polymers, Inc.) | 3 Parts |

Image receiving Formulation 3 may be prepared by mixing 3 parts cationic polymer dispersion to 60 parts ethylene acrylic co-polymer dispersion by gentle stirring. 37 parts of a polyethylene wax dispersion is then mixed into the formulation by gentle stirring.

Example 9

This example relates to another image receiving formulation, Image receiving Formulation 4

| Image receiving Formulation 4 | |
|---|---|
| Components | Parts |
| Ethylene Acrylic Copolymer(Rhoplex NW-1402 (Rohm and Haas)) | 60 Parts |
| Polyethylene Wax (Michem Emulsion 58035, (Michelman, Inc.) | 37 Parts |
| Cationic Polymer (APC-M1, Advanced Polymers, Inc.) | 3 Parts |

Image receiving Formulation 4 may be prepared by mixing 3 parts cationic polymer dispersion to 60 parts ethylene acrylic co-polymer dispersion by gentle stirring. 37 parts of a polyethylene wax dispersion is then mixed into the formulation by gentle stirring.

Example 10

This example relates to another image receiving formulation, Image receiving Formulation 5.

| Image receiving Formulation 5 | |
|---|---|
| Components | Parts |
| Water | 89 Parts |
| Cationic Polymer (APC-J81, Advanced Polymers, Inc.) | 8 Parts |
| Calcium Chloride | 2 Parts |
| Poly (ethylene oxide)(Polyox WSR N60K (Dow Chemical Co.)) | 1 Part |

Image receiving Formulation 5 may be prepared by mixing 8 parts cationic polymer dispersion to 89 parts water by gentle stirring. Two parts calcium chloride and 1 part poly(ethylene oxide) are likewise dispersed into the water solution by gentle stirring.

Example 11

This example relates to another image receiving formulation, Image receiving Formulation 6.

| Image receiving Formulation 6 | |
|---|---|
| Components | Parts |
| Ethylene Acrylic Copolymer (Michem Prime 4990 (Michelman, Inc.)) | 80 Parts |
| Wax Dispersion (Michem Emulsion 58035 (Michelman, Inc.) | 20 Parts |

Image receiving Formulation 6 may be prepared by mixing 20 parts wax dispersion to 80 parts ethylene acrylic co-polymer dispersion by gentle stirring.

Example 12

This example relates to another image receiving formulation, Image receiving Formulation 7.

| Image receiving Formulation 7 | |
|---|---|
| Components | Parts |
| Water | 83 Parts |
| Cationic Polymer (APC-J81, Advanced Polymers, Inc.) | 8 Parts |
| Polyvinyl Alcohol (Celvol 540, Celanese Co) | 5 Parts |
| Calcium Chloride | 2 Parts |
| Poly(ethylene oxide) (Polyox WSR N60K (Dow Chemical Co.)) | 1 Part |
| Glyoxal (Aldrich) | 1 Part |

Image receiving Formulation 7 may be prepared by mixing 8 parts cationic polymer dispersion to 83 parts water by gentle stirring. Five parts polyvinyl alcohol is then dispersed via gentle stirring and heating. Once the solution cools back to room temperature, two parts calcium chloride and 1 part poly(ethylene oxide) are likewise dispersed into the water solution by gentle stirring. One part glyoxal is then stirred into the mixture via gentle stirring.

Example 13

This example relates to an image receiving formulation, Image receiving Formulation 8.

Image receiving Formulation 8

| Components | Parts |
|---|---|
| Ethylene Acrylic Copolymer(Rhoplex B-15 (Rohm and Haas)) | 94 Parts |
| Cationic Polymer (APC-M1, Advanced Polymers, Inc.) | 5 Parts |
| Multifunctional Aziridine Crosslinker (XAMA-7, Sybron Co) | 1 Part |

Image receiving Formulation 8 may be prepared by mixing 5 parts cationic polymer dispersion and 1 part aziridine crosslinker to 94 parts ethylene acrylic co-polymer dispersion by gentle stirring.

Example 14

This example relates to an image receiving formulation, Image Receiving Formulation 9.

Image Receiving Formulation 9

| Components | Parts |
|---|---|
| Ethylene Vinyl Acetate Copolymer (Dur-o-set Elite Plus 25-299A (Vinamul)) | 60 Parts |
| Polyethylene Wax (Michem Emulsion Fglass X9M, (Michelman, Inc.) | 37 Parts |
| Cationic Polymer (APC-M1, Advanced Polymers, Inc.) | 3 Parts |

Image receiving Formulation 9 may be prepared by mixing 3 parts cationic polymer dispersion to 60 parts ethylene acrylic co-polymer dispersion by gentle stirring. 37 parts of a polyethylene wax dispersion is then mixed into the formulation by gentle stirring.

Example 15

This example relates to an image receiving formulation, Image Receiving Formulation 10.

Image Receiving Formulation 10

| Components | Parts |
|---|---|
| Ethylene Vinyl Acetate Copolymer (Dur-o-set Elite Plus 25-299A (Vinamul)) | 60 Parts |
| Water | 37 Parts |
| Cationic Polymer (APC-M1, Advanced Polymers, Inc.) | 3 Parts |

Image receiving Formulation 10 may be prepared by mixing 3 parts cationic polymer dispersion to 60 parts ethylene acrylic co-polymer dispersion by gentle stirring. Thirty-seven parts of water is then added under gentle stirring.

Example 16

This example relates to an image receiving layer formulation, Image Receiving Formulation 11.

Image Receiving Formulation 11

| Components | Parts by weight (DRY) |
|---|---|
| Polyquaternium-10 (Celquat SC-230M; National Starch Co.) | 0.15 parts |
| Self-crosslinking EVA polymer (Duroset Elite Plus 25-299A; Vinamul Polymers Corp.) | 15 Parts |
| Cationic Polymer (APC-M1; Advanced Polymer Inc.) | 1.8 parts |
| Nylon 6-12 (Orgasol 3501 EXDNAT 1; Atofina) | 8 parts |
| EVA (Microthene FE-532; Equistar Chem. Co) | 10 parts |
| Silica (Syloid W-500; Grace Davidson) | 15 parts |

Image Receiving Formulation 11 is displayed in dry weights. However, some of these ingredient correspond to wet amounts added to create the formulation. These wet amounts by weight are found below:

Image Receiving Formulation 11

| Components | Parts by weight (WET) |
|---|---|
| Polyquaternium-10 (Celquat SC-230M; National Starch Co.) | n/a |
| Self-crosslinking EVA polymer (Duroset Elite Plus 25-299A; Vinamul Polymers Corp.) | 30 (50% solids) |
| Water | 70 |
| Cationic Polymer (APC-M1; Advanced Polymer Inc.) | 3 (60% solids) |
| Nylon 6-12 (Orgasol 3501 EXDNAT 1; Atofina) | n/a |
| EVA (Microthene FE-532; Equistar Chem. Co) | n/a |
| Silica (Syloid W-500; Grace Davidson) | n/a |

Example 17

This example relates to an image receiving layer formulation, Image Receiving Formulation 12.

Image Receiving Formulation 12

| Components | Parts by weight (DRY) |
|---|---|
| 29% Orgasol ® 3501 EXDNAT Polyamide Resin (Atofina Chemicals, Inc. | 9.6 Parts |
| 20% EVA (Microthene FE-532; Equistar Chem. Co) | 10 Parts |
| Self-crosslinking EVA polymer (Duroset Elite Plus 25-299A; Vinamul Polymers Corp.) | 15 Parts |
| Cationic Polymer (APC-M1; Advanced Polymer Inc.) | 1.8 Parts |
| Silica (Syloid W-500; Grace Davidson) | 15 Parts |
| Alcogum ® L-520 (Alco Chemical) | 0.6 Parts |

Image Receiving Formulation 12 is displayed in dry parts by weights. However, some of these ingredient correspond to wet amounts added to create the formulation. To prepare, first two stock solutions are prepared in water. These are as follows:

| 29% Orgasol 3501 EXDNAT 1 | |
|---|---|
| Water | 100 parts |
| Triton X-100 | 3 parts (surfactant) |
| Orgasol 3501 | 30 parts |
| **20% Microthene** | |
| Water | 100 parts |
| Triton X-100 | 1 part |
| Microthene FE-532 | 20 parts |

These ingredients are then mixed with the other ingredients shown above. The mixing is performed wet, and the amounts in Wet parts by weight are shown below:

| Components | Parts by weight (WET) |
|---|---|
| 29% Orgasol ® 3501 EXDNAT Polyamide Resin (Atofina Chemicals, Inc. | 33 |
| 20% EVA (Microthene FE-532; Equistar Chem. Co) | 50 |
| Self-crosslinking EVA polymer (Duroset Elite Plus 25-299A; Vinamul Vinamul Polymers Corp.) | 30 (50% solids) |
| Cationic Polymer (APC-M1; Advanced Polymer Inc.) | 3 (60% solids) |
| Silica (Syloid W-500; Grace Davidson) | n/a |
| Alcogum ® L-520 (Alco Chemical) | 3 (20% solids) |

Example 18

A transfer sheet according to the present invention is prepared as follows:

A spunlace Grade SX-174 (Green Bay Nonwovens) web layer is impregnated using Image receiving layer Formulation 4 via a dunk and squeeze application method. Image receiving Formulation 1 pick-up coat weight will be from about 10 to 200% based on the weight of the web layer.

After impregnation and thermal drying, the web back surface of the web layer is coated with an adhesion layer of Adhesion Layer Formulation 1. The adhesion layer was applied at a dry coat of about 20 g/m$^2$. Next, the adhesion side of the web layer is attached to a support material by placing the web layer against the support by gentle pressure. Under gentle pressure, the tack of the adhesive layer will form a reversible bond with the support. Then, an image is formed on the side of the web layer opposite the support material by an ink jet printer.

The transfer of the image area from the image transfer sheet is completed by peeling the imaged web layer and adhesion layer from the support material, and placing the peeled web image side up on a cotton shirt. Next a non-stick sheet is placed on top of the imaged web and heat and pressure from a conventional iron set on its highest temperature setting is applied through the non-stick sheet for a time sufficient to transfer the image area to the shirt (e.g. 3-5 minutes). Lastly, the non-stick sheet is removed.

Example 19

Example 16 is repeated, except that the back surface of the support (opposite the web layer) is coated with the following antistatic layer:

| Antistatic Layer Solution Formulation 1 | |
|---|---|
| Components | Parts |
| Water | 90 parts (by weight) |
| Quaternary ammonium salt solution (Statik-Blok J-2, Amstat Industries) | 10 parts (by weight) |

The antistatic solution is applied in a long line across the top edge of the support material using a #4 metering rod. The coated support is force air dried for approximately one minute. The antistatic solution of this Example has the following characteristics: the solution viscosity as measured on a Brookfield DV-I+ viscometer, LV1 spindle@60 RPM is 2.0 (cP) at 24.5° C. The coating weight (wet) was 15 g/m$^2$. The surface tension is 69.5 dynes/cm at 24° C.

Once the support and antistatic coating are dry, the uncoated side of the support is joined with the adhesion layer coated side of the web layer.

Example 20

Example 17 is repeated, except that following formulation is used as the antistatic layer:

| Antistatic Layer Solution Formulation 2 | |
|---|---|
| Components | Parts |
| Water | 95 parts (by weight) |
| Polyether (Marklear ALF-23, Witco Ind.) | 5 parts (by weight) |

Example 21

This example relates to a Barrier Layer Formulation 1:

| Barrier Layer Formulation 1 | |
|---|---|
| Components | Parts |
| Ethylene Acrylic Acid Copolymer (Hycar 26138 (Noveon, Co.) | 100 |

Example 22

An example of optional Opaque Layer A is as follows:

| Opaque Layer A Formulation 1 | |
|---|---|
| Ingredient | Parts |
| Stryrene-Butadiene Latex (Latex CP 615NA, Dow Chemical Co., Midland, MI) | 40 |
| Pigment in Resin Solution (Arrowvure F. Flink Ink CO., W. Hazelton, PA) | 25 |
| Thermoplastic Elastomer (Hystretch V-29, BF Goodrich, Cleveland, OH) | 17.5 |
| Elastomer (Hycar 1561, BF Goodrich, Cleveland, OH) | 17.5 |

Example 23

An example of optional Opaque Layer B is as follows:

| Opaque Layer B Formulation 1 | |
|---|---|
| Ingrediant | Parts |
| Vinyl Acetate-Ethylene Copolymer (Airflex 124, Airproducts Inc., Allentown, PA) | 35 |
| TiO2 Powder Pigment (TiPure R706, DuPont Chemicals, Wilmington, DE) | 25 |
| Thermoplastic Elastomer (Hystretch V-29, BF Goodrich, Cleveland, OH) | 25 |
| Elastomer 15 (Hycar 1561, BF Goodrich, Cleveland, OH). | |

Example 24

A Spunlace Grade SX-174 (Green Bay Nonwovens) web layer is impregnated using Image receiving layer Formulation 9 via a dunk and squeeze application method. Image receiving layer Formulation 9 pick-up coat weight will be from about 10 to 200% based on the weight of the web layer.

After impregnation and thermal drying, the web back surface of the web layer is coated with an adhesion layer of Adhesion Layer Formulation 1. The adhesion layer was applied at a dry coat of 20 g/m$^2$. Then, an image is formed on the side of the web layer opposite the adhesion layer with a marker.

The transfer of the image area from the image transfer sheet is completed by placing the web image side up on a cotton shirt. Next a non-stick sheet is placed on top of the imaged web and heat and pressure from a conventional iron set on its highest temperature setting is applied through the non-stick sheet for a time sufficient to transfer the image area to the shirt (e.g. 3-5 minutes). Lastly, the non-stick sheet is removed.

Example 25

Various image receiving formulations were applied to a Green Bay Non-woven SX-174 web using a dunk and squeeze application method. Approximate wet pick-up was about 200% based on the weight of the uncoated web. The various components, used in the image receiving layer composition, evaluated are described above.

The various image receiving formulations evaluated are illustrated in Table 1. All numerical units are measured in parts by weight. The comparative examples range from an untreated web (I) to a web that just contains a Image Receiving Formulation (II) to a web that just contains a dye retention aid, for instance a cationic polymer (III). Another tested dye retention aid is $CaCl_2$. The inventive examples include at least one image receiving formulation binder and at least one dye retention aid. Glyoxal is used when PVOH is present.

TABLE 1

Various Image receiving formulations.

| Image Composition | Adhesion layer Binder | Image receiving formulation Binder | Cationic Polymer | Glyoxal | $CaCl_2$ | Water | I or C[A] |
|---|---|---|---|---|---|---|---|
| I | None | None | None | None | None | None | C |
| II | None | D, 5 | None | None | None | 95 | C |
| III | None | None | A, 5 | None | None | 95 | C |
| IV | None | D, 5 | None | None | 2 | 93 | I |
| V | None | D, 5 | None | 1 | 2 | 92 | I |
| VI | C, 80; A, 20 | None | None | None | None | None | I |
| VII | None | A, 95 | A, 5 | None | None | None | I |
| VIII | None | A, 92 | B, 8 | None | None | None | I |
| IX[B] | None | None | B, 8 | None | 2 | 89 | I |
| X[B] | None | D, 5 | B, 8 | 1 | 2 | 83 | I |
| XI | A, 30 | A, 67 | A, 3 | None | None | None | I |
| XII | A, 30 | B, 67 | A, 3 | None | None | None | I |
| XIII | A, 30 | C, 67 | B, 3 | None | None | None | I |
| XIV | None | A, 50 | B, 3 | None | None | 47 | I |
| XV | None | A, 75 | B, 3 | None | None | 22 | I |
| XVI | A, 30 | None | B, 3 | None | None | 67 | C |
| XVII | A, 30 | C, 30 | B, 3 | None | None | 37 | I |

[A]I—Inventive or C—Comparative
[B]Contains Polyox WSR N60K at 1 part

An ink jet printed test image was applied onto the coated web using a Hewlett Packard 960c printer. After printing, the web was placed inside the fold of a folded non-stick sheet. The folded sheet, with the printed web inside, was hand ironed with a Perfection Model 14A4686 hand iron set on the linen heat setting. The web was ironed, on both sides, for approximately 15 seconds. The printed web was then inspected for image quality and dry time; and then, was placed into a cold water bath for 24 hours. The evaluation of the printed web is illustrated in Table II.

TABLE II

Evaluation of Image Quality and Waterfastness.

| Image Composition | Initial Image Quality | Dry Time | Waterfastness |
|---|---|---|---|
| I | Good | Good | Poor |
| II | Good | Good | Poor |

TABLE II-continued

Evaluation of Image Quality and Waterfastness.

| Image Composition | Initial Image Quality | Dry Time | Waterfastness |
|---|---|---|---|
| III | Good | Good | Poor |
| IV | Good | Good | Fair |
| V | Good | Good | Fair |
| VI | Fair | Fair | Fair |
| VII | Good | Good | Good |
| VIII | Good | Good | Good |
| VIX | Good | Good | Fair |
| X | Good | Good | Fair |
| XI | Excellent | Excellent | Excellent |
| XII | Excellent | Good | Excellent |
| XIII | Excellent | Good | Excellent |
| XIV | Excellent | Good | Fair |
| XV | Excellent | Good | Fair |
| XVI | Good | Good | Fair |
| XVII | Good | Good | Fair |

A good to excellent rating in the image quality category represents an observation that the image quality exhibited a resolved and vibrant color rendition of the test target without any apparent image bleeding. A fair rating represented noticeable image bleeding of the test target. A good to excellent rating in the dry time category represents an image that was dry to the touch coming out of the printer. A fair dry time represents an image that is damp to the touch, but does not result in image smearing. A good to excellent waterfastness represents an observation of little to no dye run-off into the water bath. A fair waterfast rating represents a dye run-off equal up to about 50% of the image dye. A poor waterfast rating represents an image that washed off (more than 50% dye run-off) when placed into the water bath.

All cited patents, publications, copending applications, and provisional applications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image transfer sheet, comprising:

a woven or non-woven web layer having on one side thereof at least one adhesion layer, said web layer having impregnated therein or coated thereon on the side opposite said adhesion layer, or both impregnated and coated thereon on the side opposite said adhesion layer, an image receiving formulation comprising at least one binder and at least one dye retention aid; wherein said image receiving formulation is capable of heat sealing an image upon the application of heat up to 220° C.

2. The image transfer sheet according to claim 1, wherein said image receiving formulation is present on said web layer on the side opposite said adhesion layer.

3. The image transfer sheet according to claim 1, wherein said binder is capable of melting upon heating and encapsulating an image.

4. The image transfer sheet according to claim 1, wherein said web layer comprises woven or non-woven synthetic fibers.

5. The image transfer sheet according to claim 4, wherein said web layer is capable of absorbing from 0% to 200% by weight of said image receiving formulation based upon the unimpregnated weight of the web layer.

6. The image transfer sheet according to claim 4, wherein said synthetic fibers comprise at least one polymer selected from the group consisting of polyester, rayon, nylon, polyolefin, polypropylene, and polyethylene.

7. The image transfer sheet according to claim 4, wherein said synthetic fibers comprise polyester.

8. The image transfer sheet according to claim 1, wherein an 8.5×11 inch sheet of said web layer has a weight greater than about 0.01 ounce.

9. The image transfer sheet according to claim 1, wherein an 8.5×11 inch sheet of said web layer has a weight in the range of between about 0.01 ounce to about 5 ounces.

10. The image transfer sheet according to claim 1, wherein said web layer is impregnated with said image receiving formulation.

11. The image transfer sheet according to claim 1, wherein in said image receiving formulation, said at least one binder is an acrylic binder.

12. The image transfer sheet according to claim 1, wherein said at least one dye retention aid is a cationic polymer.

13. The image transfer sheet according to claim 1, wherein said at least one dye retention aid is at least one selected from the group consisting of a polyamide copolymer, silica and PVA.

14. The image transfer sheet according to claim 12, wherein said cationic polymer is a polydiallylmethylamine hydrochloride resin.

15. The image transfer sheet according to claim 1, wherein said image receiving formulation further comprises an opacifying agent.

16. The image transfer sheet according to claim 15, wherein said opacifying agent is titanium dioxide.

17. A kit comprising:

an image transfer sheet according to claim 1; and optionally instructions for using said transfer sheet and/or a non-stick sheet.

18. The image transfer sheet according to claim 1, wherein said image receiving formulation is added in an amount of 1% to 200% by weight relative to the uncoated weight of the web layer.

19. The image transfer sheet according to claim 1, wherein said adhesion layer has a dry coat weight of about 2 to about 40 g/m2, preferably 10-30 g/m$^2$; and, most preferrably 15-25 g/m$^2$.

20. The image transfer sheet according to claim 1, further comprising at least one opaque layer between said adhesion layer and said web layer.

21. A process for heat transferring an imaged area from a transfer sheet to a receptor element, comprising the steps:

(a) providing an image transfer sheet according to claim 1;

(b) imaging the surface of said impregnated web layer or web layer coated with said image receiving formulation;

(c) placing the imaged transfer sheet on top of a receptor element, imaged side facing away from the receptor element;

(d) optionally placing a non-stick sheet on top of said imaged transfer sheet;

(e) applying heat to imaged transfer sheet.

22. The process according to claim 21, wherein said heat is applied to the imaged side of said transfer sheet or through the non-stick sheet, if present, or from the non-imaged side of the transfer sheet through the receptor.

23. The process according to claim 21, wherein said heat is applied at a temperature from about 110 to 220° C.

24. An image transfer sheet, comprising:

a support sheet having a first and a second surface;

at least one adhesion layer on the first surface of said support sheet; and a woven or non-woven web layer on said adhesion layer, having impregnated therein or coated thereon on the side opposite said adhesion layer or both impregnated and coated thereon on the side opposite said adhesion layer, an image receiving formulation comprising at least one binder and at least one dye retention aid; wherein said image receiving formulation is capable of heat sealing the image upon the application of heat up to 220° C.

25. The image transfer sheet according to claim 24, wherein said binder is capable of melting upon heating and encapsulating an image.

26. The image transfer sheet according to claim 24, which further comprises an antistatic layer on the second surface of said support sheet.

27. The image transfer sheet according to claim 24, wherein said web layer comprises woven or non-woven synthetic fibers.

28. The image transfer sheet according to claim 27, wherein said web layer is capable of absorbing from 0% to 200% by weight of said image receiving formulation based upon the unimpregnated weight of the web layer.

29. The image transfer sheet according to claim 27, wherein said synthetic fibers comprise at least one polymer selected from the group consisting of polyester, rayon, nylon, polyolefin, polypropylene, and polyethylene.

30. The image transfer sheet according to claim 27, wherein said synthetic fibers comprise polyester.

31. The image transfer sheet according to claim 24, wherein an 8.5×11 inch sheet of said web layer has a weight greater than about 0.01 ounce.

32. The image transfer sheet according to claim 24, wherein an 8.5×11 inch sheet of said web layer has a weight in the range of between about 0.01 ounce to about 5 ounces.

33. The image transfer sheet according to claim 24, wherein said web layer is impregnated with said image receiving formulation.

34. The image transfer sheet according to claim 24, wherein said at least one binder is an acrylate binder.

35. The image transfer sheet according to claim 24, wherein said at least one dye retention aid is a cationic polymer.

36. The image transfer sheet according to claim 24, wherein said at least one dye retention aid is at least one selected from the group consisting of a polyamide copolymer, silica and PVA.

37. The image transfer sheet according to claim 35, wherein cationic polymer is a polydiallylmethylamine hydrochloride resin.

38. The image transfer sheet according to claim 24, wherein said image receiving formulation further comprises an opacifying agent.

39. The image transfer sheet according to claim 38, wherein said opacifying agent is titanium dioxide.

40. A process for heat transferring an imaged area from a transfer sheet to a receptor element, comprising the steps:

(a) providing an image transfer sheet according to claim 24;

(b) imaging the surface of said transfer sheet on the side opposite said adhesion layer;

(c) peeling said imaged web layer and adhesion layer away from the support material;

(d) placing the imaged transfer sheet on top of a receptor element, imaged side facing away from the receptor element;

(e) optionally placing a non-stick sheet on top of said imaged transfer sheet;

(f) applying heat to the imaged transfer sheet.

41. The process according to claim 40, wherein said heat is applied to the imaged side of said transfer sheet or through the non-stick sheet, if present, or from the non-imaged side of the transfer sheet through the receptor.

42. The process according to claim 40, wherein said heat is applied at a temperature from about 110 to 220° C.

43. A kit comprising:

an image transfer sheet according to claim 24; and optionally instructions for using said transfer sheet and/or a non-stick sheet.

44. The image transfer sheet according to claim 24, wherein said image receiving formulation is added in an amount of 1% to 200% by weight relative to the uncoated weight of the web layer.

45. The image transfer sheet according to claim 24, wherein said adhesion layer has a dry coat weight of about 2 to about 40 g/m2, preferably 10-30 g/m$^2$; and, most preferrably 15-25 g/m$^2$.

46. The image transfer sheet according to claim 24, wherein said binder is capable of melting upon heating and encapsulating an image.

47. An image transfer sheet, comprising:

a woven or non-woven web layer having on one side thereof at least one adhesion layer, said web layer having impregnated therein or coated thereon on the side opposite said adhesion layer, or both impregnated and coated thereon on the side opposite said adhesion layer, an image receiving formulation comprising at least one self-crosslinking polymer; and at least one dye retention aid; wherein said image receiving formulation is capable of heat sealing an image upon the application of heat up to 220° C.

48. The image transfer sheet according to claim 47, wherein said self-crosslinking polymer is a self-crosslinking ethylene vinyl acetate polymer.

49. The image transfer sheet according to claim 47, said image receiving formulation further comprising at least one thermoplastic binder other than the self-crosslinking polymer.

50. The image transfer sheet according to claim 49, wherein said at least one thermoplastic binder is an ethylene vinyl acetate copolymer.

51. The image transfer sheet according to claim 47, said at least one dye retention aid is a cationic polymer.

52. The image transfer sheet according to claim 47, wherein said at least one dye retention aid is silica.

53. The image transfer sheet according to claim 47, said image receiving formulation further comprising an opacifying agent.

54. The image transfer sheet according to claim 47, wherein said self-crosslinking polymer is present in an amount of 15-40% by weight based upon the dry solids weight of the formulation.

55. The image transfer sheet according to claim 51, wherein said cationic polymer is present in an amount of 1-10% by weight based upon the dry solids weight of the formulation.

56. The image transfer sheet according to claim 47, further comprising a polyamide copolymer is present in an amount of 5-40% by weight based upon the dry solids weight of the formulation.

57. The image transfer sheet according to claim 56, wherein said polyamide copolymer is present in an amount of 5-40% by weight based upon the dry solids weight of the formulation.

58. The image transfer sheet according to claim 49, wherein said thermoplastic polymer other than the self-crosslinking polymer is present in an amount of 5-40% by weight based upon the dry solids weight of the formulation.

59. The image transfer sheet according to claim 52, wherein said silica is present in an amount of 5-60% by weight based upon the dry solids weight of the formulation.

60. The image transfer sheet according to claim 47, wherein said at least one dye retention aid is at least one selected from the group consisting of a cationic polymer, a polyamide copolymer, silica or PVA.

61. The image transfer sheet according to claim 47, wherein said image receiving formulation comprises:

15-40% by weight of at least one self-crosslinking polymer;

5-40% by weight of at least one thermoplastic polymer other than said self-crosslinking polymer;

5-40% by weight of at least one polyamide copolymer;

1-10% by weight of at least one cationic polymer;

5-60% by weight of silica, wherein said % by weight is based upon a 100% total dry weight of the composition.

62. The image transfer sheet according to claim 61, wherein said image receiving formulation comprises:

25-35% by weight of at least one self-crosslinking polymer;

10-30% by weight of at least one thermoplastic polymer other than said self-crosslinking polymer;

10-30% by weight of at least one polyamide copolymer;

1-4% by weight of at least one cationic polymer; and 10-40% by weight of silica, wherein said % by weight is based upon a 100% total dry weight of the formulation.

* * * * *